US010660385B2

(12) United States Patent
Nagao et al.

(10) Patent No.: US 10,660,385 B2
(45) Date of Patent: May 26, 2020

(54) MASK

(71) Applicant: SAN-M PACKAGE CO., LTD., Shizuoka (JP)

(72) Inventors: Shogo Nagao, Shizuoka (JP); Yasuhiro Kohga, Shizuoka (JP)

(73) Assignee: San-M Package Co., Ltd., Shizuoka (JP)

( * ) Notice: Subject to any disclaimer, the term of this patent is extended or adjusted under 35 U.S.C. 154(b) by 0 days.

(21) Appl. No.: 13/949,482

(22) Filed: Jul. 24, 2013

(65) Prior Publication Data

US 2014/0182602 A1 Jul. 3, 2014

(30) Foreign Application Priority Data

Dec. 28, 2012 (JP) ..... 2012-287522

(51) Int. Cl.
*A41D 13/11* (2006.01)

(52) U.S. Cl.
CPC ..... *A41D 13/1161* (2013.01); *A41D 13/1192* (2013.01)

(58) Field of Classification Search
CPC ..... A62B 18/02; A62B 18/025; A41D 13/11; A41D 13/1161
USPC ..... 128/857–858, 863
See application file for complete search history.

(56) References Cited

U.S. PATENT DOCUMENTS 5,699,792 A * 12/1997 Reese et al. ..... 128/206.19
5,706,804 A * 1/1998 Baumann ..... A41D 13/1115 128/206.12
7,044,993 B1 * 5/2006 Bolduc ..... A62B 18/025 261/104
2005/0133036 A1 * 6/2005 Steindorf ..... 128/206.19
2006/0219247 A1 * 10/2006 Hanlon ..... A41D 13/1169 128/207.18
2006/0266364 A1 * 11/2006 Turdjian ..... A41D 31/0016 128/206.19
2008/0110469 A1 * 5/2008 Weinberg ..... 128/863
(Continued)

FOREIGN PATENT DOCUMENTS

EP 0752214 A1 1/1997
EP 1990071 A1 11/2008
(Continued)

OTHER PUBLICATIONS

Office Action for Australia Patent Application No. 2013209306 dated Nov. 26, 2014, 7 pages.
(Continued)

*Primary Examiner* — Anna K Kinsaul
*Assistant Examiner* — Camtu T Nguyen
(74) *Attorney, Agent, or Firm* — Kilpatrick Townsend & Stockton LLP

(57) ABSTRACT

A mask including: a mask main body 11; and a cord 12 that is placed over both ears or the head of a wearer to fix the mask main body 11 at a specific position on the face of the wearer, wherein the mask main body includes an inner layer 15 that is positioned on the side of the mouth of the wearer when the mask is being worn, an outer layer 17 that is on the outside of the mask when the mask is being worn, and a filter layer 16 that is positioned between the inner layer 15 and the outer layer 17, the filter layer 16 including two or more layers of a melt blown nonwoven fabric layer.

11 Claims, 5 Drawing Sheets

(56) References Cited

U.S. PATENT DOCUMENTS

| | | | | |
|---|---|---|---|---|
| 2010/0307503 | A1 | 12/2010 | Iwamoto et al. | |
| 2011/0209711 | A1 | 9/2011 | Brillat | |
| 2012/0082711 | A1* | 4/2012 | Goranov | A01N 59/16 424/404 |
| 2012/0180800 | A1 | 7/2012 | Shibata et al. | |
| 2013/0047856 | A1* | 2/2013 | Takeuchi | A62B 23/025 96/17 |

FOREIGN PATENT DOCUMENTS

| | | | |
|---|---|---|---|
| EP | 2462992 | A1 | 6/2012 |
| JP | 61-272063 | A | 12/1986 |
| JP | H08-89591 | A | 4/1996 |
| JP | 2001-515237 | A | 9/2001 |
| JP | 2004-073603 | A | 3/2004 |
| JP | 2007-054381 | A | 3/2007 |
| JP | 2008-055036 | A | 3/2008 |
| WO | 2009/130799 | A1 | 10/2009 |
| WO | 2010/138426 | A1 | 12/2010 |
| WO | 2011/016462 | A2 | 2/2011 |

OTHER PUBLICATIONS

Office Action for Japan Patent Application No. 2012-287522 dated Nov. 25, 2014 with English translation, 5 pages.
European Search Report for European Application No. EP 13176769 dated Feb. 24, 2015, 6 pages.
Office Action in JP 2012-287522, dated Apr. 3, 2015 (and translation).

* cited by examiner

MASK

This application claims priority under 35 USC 119 from Japanese Patent Application No. 2012-287522, the disclosure of which is incorporated by reference herein

BACKGROUND

Technical Field

The present invention relates to a mask, and in particular relates to a mask with excellent Bacterial Filtration Efficiency (BFE) and low breathing resistance.

Related Art

Generally, masks are designed so as to cover the nose and the mouth for the purpose of preventing bacteria, viruses and the like from entering, and preventing penetration of blood.

In general, such masks usually have a 3 layer configuration including an outer layer, a filter layer, and an inner layer (Japanese Patent Application Laid-Open (JP-A) No. 61-272063).

The main purpose of the outer layer is to protect the filter layer, however it may for example be colored to make it fashionable, and a spunbond nonwoven fabric such as polypropylene is generally employed for the outer layer.

The filter layer is the most important material configuring the mask, and functions to filter out bacteria, viruses, pollen and the like. The filter layer is accordingly generally designed by employing fine diameter fibers such that foreign objects do not readily pass through, whilst air passes through easily. There are also filter layers designed such that foreign objects adhere through static electricity by statically charging the filter layer (JP-A No. 61-272063).

The inner layer is positioned on the side of the mouth of the wearer, and is a portion that makes direct contact with the skin of the wearer. The inner layer is accordingly designed so as not to cause skin irritation through contact. Generally, materials such as thermal bonded nonwoven fabric, mixed material papers made from a mixture of pulp and polyester fibers, and rayon papers are employed for the inner layer.

Recently, masks are being sold that have new styles of filter layer for increasing the filtration efficiency against bacteria, viruses and the like, and for reducing breathing resistance.

There are also masks employing multiple layers of nonwoven fabrics, for example a 3 layer structure of spunbond/melt blown/spunbond nonwoven fabrics (Japanese National-Phase Publication No. 2001-515237).

However, for general purpose masks, attempts to increase the filtration efficiency against foreign objects makes it necessary to make the filter layer thicker, or to add new nonwoven fabric layers to the filter layer, with the issue arising that breathing resistance increases, resulting in difficulty in breathing with prolonged wearing. As a result, the wearer may occasionally remove the mask to recover their breath, dramatically reducing the efficiency of the mask.

Moreover, there is also an issue that since there is a large variability in the grammage of nonwoven fabrics configuring the filter layer, there is a possibility in masks for which blood fluid impermeability is demanded that blood penetration occurring at portions where the grammage of nonwoven fabric in the filter layer is low.

Since manufacturing methods of new style filter layers are very particular, controlling the performance thereof is difficult, with a large amount of variability both within the same batch and between batches compared to that of existing filter layers, and with a larger variability in the grammage of nonwoven fabrics than with existing filter layers. Accordingly, in attempting to secure filtration performance against foreign objects, excessive quality must be achieved, such that the use of such filters is unavoidably limited from a cost efficiency perspective.

There is also the issue that formability decreases, and productivity is reduced for example when the filter layer is made thicker and additional nonwoven fabric layers are introduced to the filter layer in order to increase filtration efficiency.

The present invention addresses the above issues, and an object thereof is to provide a mask with excellent filtration efficiency against foreign objects such as bacteria, viruses and pollen, with low breathing resistance, and with little variability in performance.

SUMMARY

A first aspect of the present invention relates to a mask including: a mask main body; and a cord that is placed over both ears or the head of a wearer to fix the mask main body at a specific position on the face of the wearer, wherein the mask main body includes an inner layer that is positioned on the side of the mouth of the wearer when the mask is being worn, an outer layer that is on the outside of the mask when the mask is being worn, and a filter layer that is positioned between the inner layer and the outer layer, the filter layer including two or more layers of a melt blown nonwoven fabric layer.

In this mask, the filter layer is configured from the two or more superimposed layers of melt blown nonwoven fabric layer. Variability in filtration performance caused by variability in grammage inherent in the nonwoven fabric can accordingly be effectively suppressed, with excellent filtration efficiency against foreign objects such as bacteria, viruses, pollen and the like. Differential pressure is small in melt blown nonwoven fabric, such that breathing resistance is low regardless of the excellent foreign object filtration efficiency.

A second aspect of the present invention is the mask of the first aspect wherein the filter layer is formed by superimposing the melt blown nonwoven fabric layers on each other.

In this mask, the filter layer is configured from the superimposed melt blown nonwoven fabric layers, suppressing the inherent variability in grammage thereof, and increasing uniformity.

A third aspect of the present invention is the mask of the first aspect wherein the filter layer further includes an insert layer that is a layer of a nonwoven fabric that differs from the melt blown nonwoven fabric layer in characteristics, or material, or both characteristics and material.

In this mask, the insert layer is combined with the plural melt blown nonwoven fabric layers in the filter layer, thereby enabling even higher filtration efficiency against bacteria and the like, and even higher blood fluid impermeability (Fluid Resistance), to be achieved.

A fourth aspect of the present invention is the mask of the third aspect wherein the insert layer is an antimicrobial nonwoven fabric layer configured from an antimicrobial treated nonwoven fabric.

In this mask, the antimicrobial nonwoven fabric of the insert layer is combined with the plural melt blown nonwoven fabric layers of the filter layer to give even higher filtration efficiency against bacteria and viruses than in a mask having only the plural melt blown nonwoven fabric layers as the filter layer.

A fifth aspect of the present invention is the mask of the third aspect wherein the insert layer is a blood fluid blocking layer that suppresses the permeation of blood.

In this mask, the filter layer is configured by the blood fluid blocking layer as the insert layer combined with the plural melt blown nonwoven fabric layers. Blood fluid impermeability (Fluid Resistance) is accordingly even better than in a mask having only the plural melt blown nonwoven fabric layers as the filter layer.

According to the present invention as described above, a mask is provided that has excellent filtration efficiency against foreign objects, low breathing resistance, and little variability in performance.

BRIEF DESCRIPTION OF THE DRAWINGS

Exemplary embodiments of the present invention will be described in detail based on the following figures, wherein.

EXEMPLARY EMBODIMENT

1. First Exemplary Embodiment

Explanation follows regarding an example of a mask of the present invention, with reference to the drawings.

As illustrated in FIG. 1 to FIG. 4A to 4C, a mask 1 according to a first exemplary embodiment includes a mask main body 11 that when worn covers the nose and mouth of a wearer, and two elastic cords 12 that are provided to both sides of the mask main body 11 to retain the mask main body 11 at a specific position against the face of the wearer.

Figure 3:
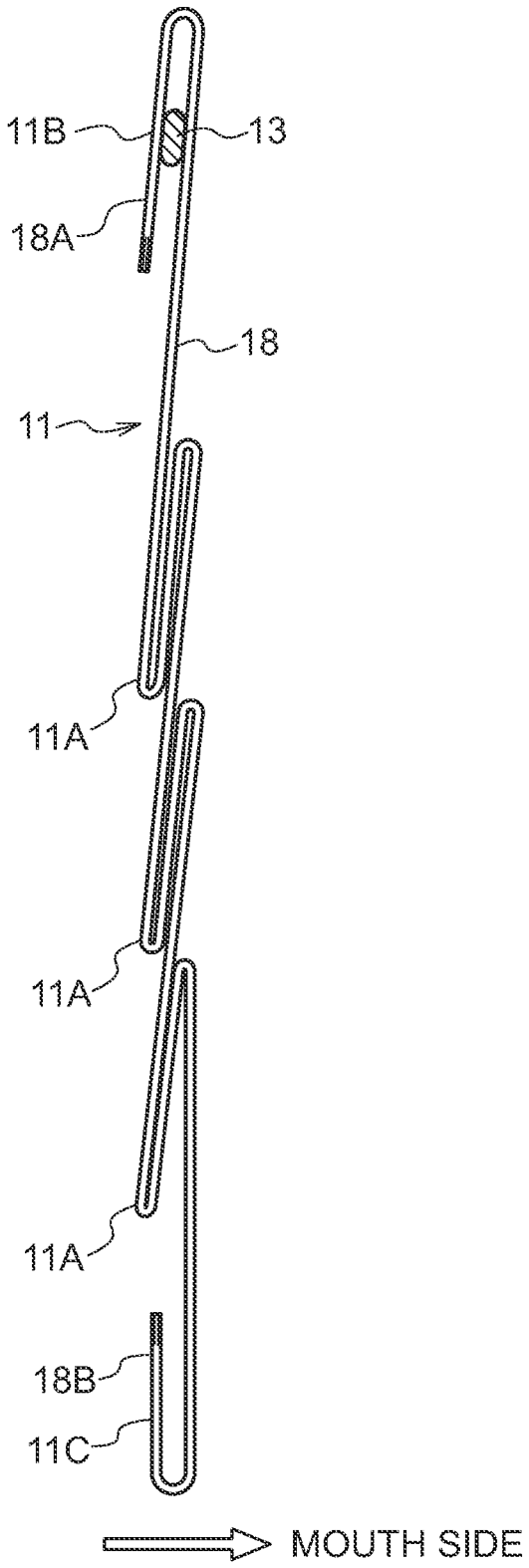
FIG. 3 is a cross-section taken along plane A-A in FIG. 1, illustrating a mask of the first exemplary embodiment.
Figure 4A:
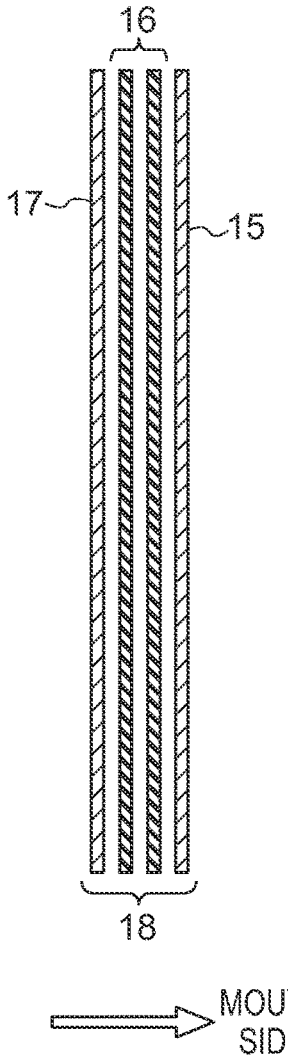
FIG. 4A to FIG. 4D are schematic cross-sections illustrating combinations of inner layers, filter layers, and outer layers of masks of the first exemplary embodiment.
Figure 4B:
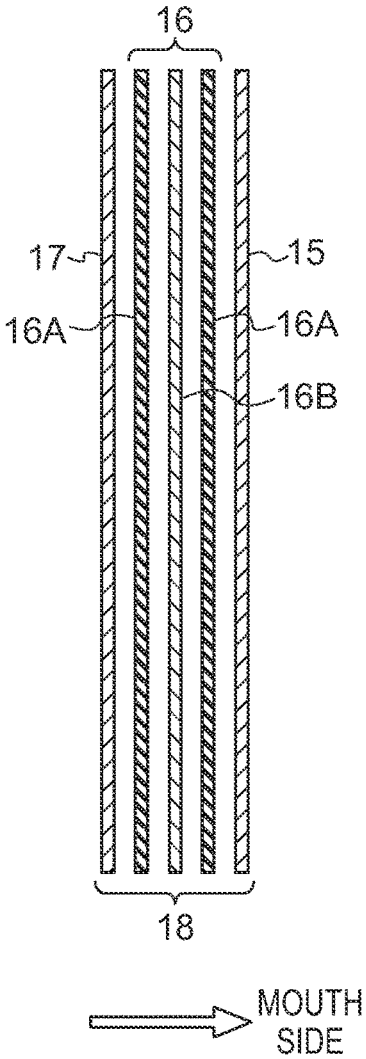

As illustrated in FIG. 4A and FIG. 4B, the mask main body 11 is formed from a nonwoven fabric layered body, namely a fabric 18, that is layered so as to form an inner layer 15, filter layers 16, and an outer layer 17, in sequence from the mouth side of the wearer. In the nonwoven fabric layered body of FIG. 4A, the filter layer 16 is configured of 2 layers of melt blown nonwoven fabric layers. In the nonwoven fabric layered body of the example illustrated in FIG. 4B, the filter layer 16 includes two layers of melt blown nonwoven fabric layers 16A and an insert layer 16B inserted between the melt blown nonwoven fabric layers 16A. Note that although there are two layers of the melt blown nonwoven fabric layers 16A configuring the filter layers 16 of the examples illustrated in FIG. 4A to FIG. 4C, 3 or more layers of the melt blown nonwoven fabric layers 16A may be provided.

Figure 1:
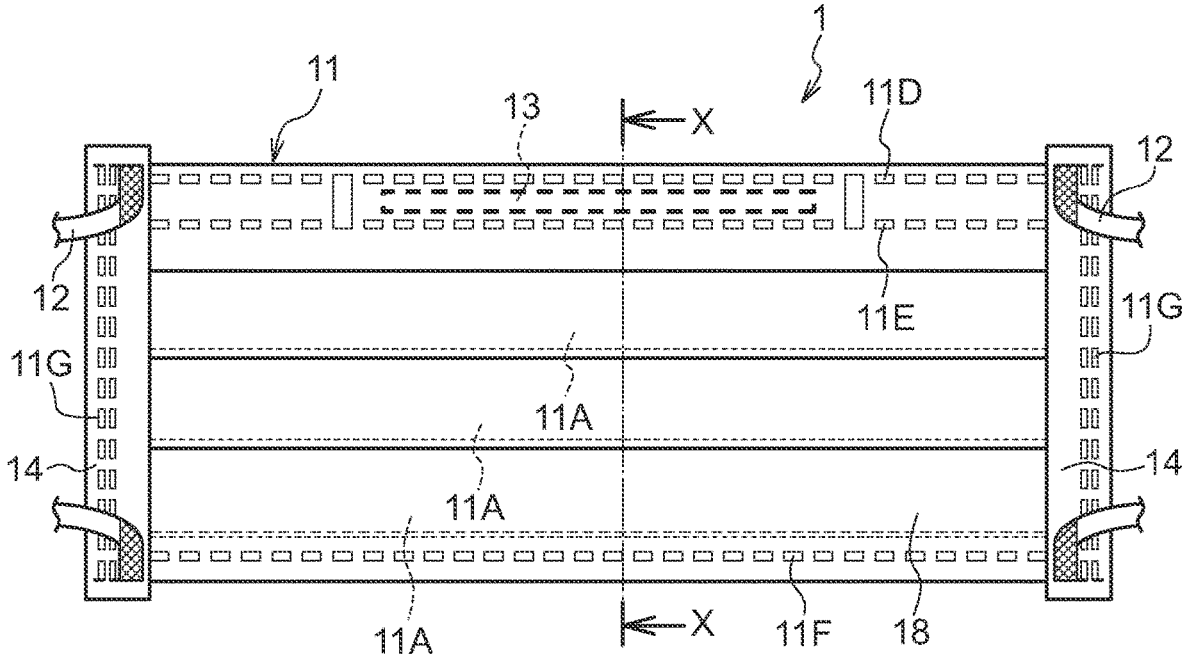
FIG. 1 is a plan view illustrating a configuration of a mask of a first exemplary embodiment as viewed from an inner layer side.
Figure 2:
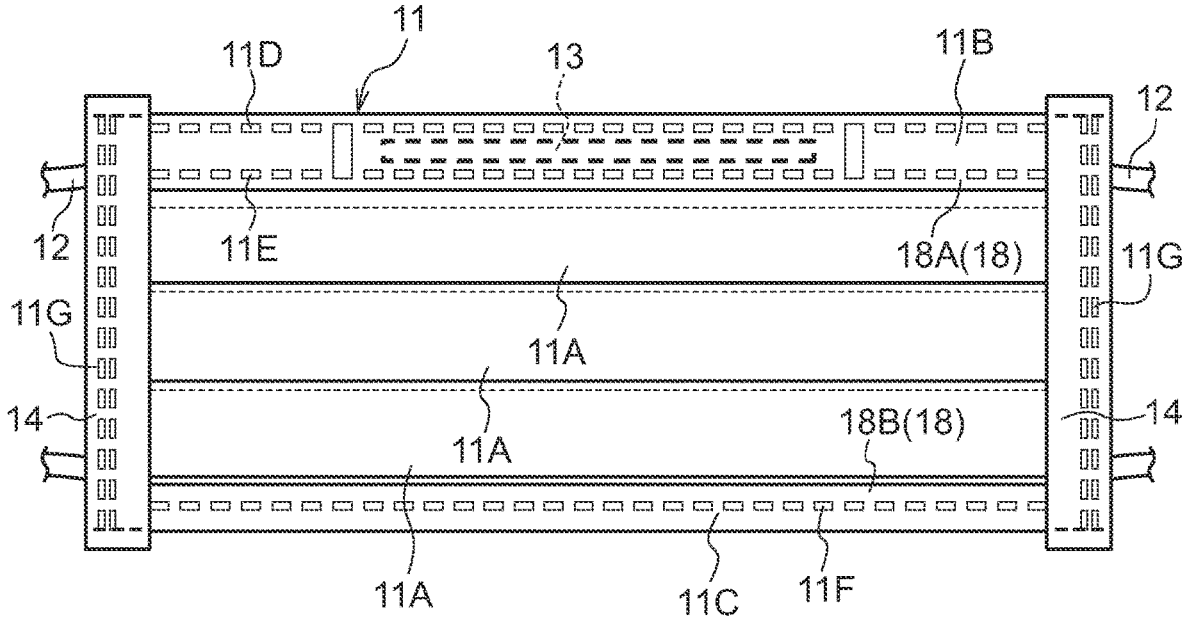
FIG. 2 is a plan view illustrating a configuration of a mask of the first exemplary embodiment as viewed from an outer layer side.

As illustrated in FIG. 3, the mask main body 11 is formed by folding the fabric 18 illustrated in FIG. 4A and FIG. 4B such that the surfaces that are on the outside when worn, namely outer surfaces, form ridges, and the surfaces that are on the mouth side when worn, namely rear surfaces, form valleys. In the mask main body 11, the folded portions of the fabric 18 configure folded-over portions 11A. As illustrated in FIG. 1 and FIG. 2, the folded-over portions 11A run along the lateral direction to form 3 locations in the up-down direction.

As illustrated in FIG. 1 to FIG. 3, in the mask main body 11 an upper edge 18A of the fabric 18 is folded over towards the front and welded at weld lines 11D and 11E to configure an upper edge portion 11B. Similarly, a lower edge 18B of the fabric 18 is folded over towards the front and welded at a weld line 11F to configure a lower edge portion 11C. A nose grip 13 formed from an aluminum flat bar is embedded between the weld lines 11D and 11E at the upper edge portion 11B.

As illustrated in FIG. 1 and FIG. 2, a reinforcement strip 14 configured from a material selected from a group including a nonwoven fabric sheet, a nonwoven fabric laminate, and a film is folded in a direction from the front surface of the mask main body 11 toward the side of the mouth of the wearer and welded along weld lines 11G at both sides of the mask main body 11.

Figure 4C:
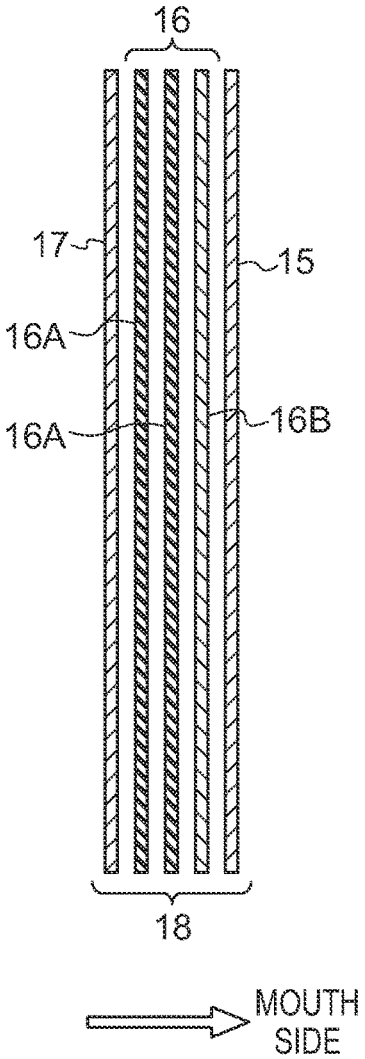
Figure 4D:
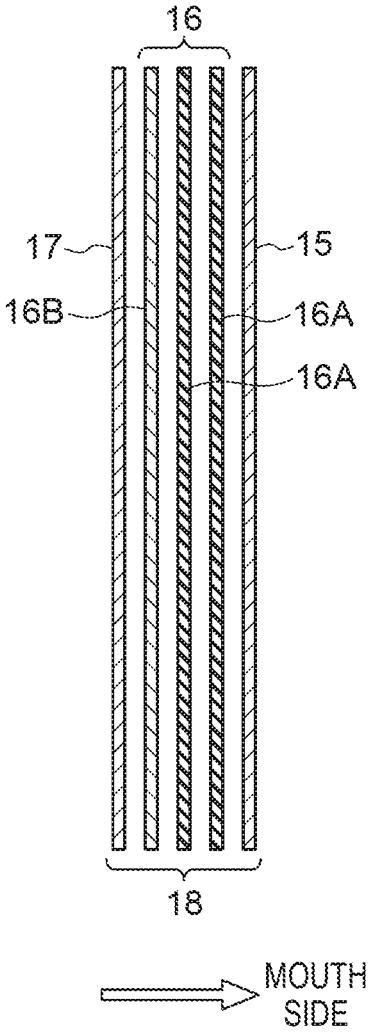

Detailed explanation follows regarding each layer configuring the fabric 18. As described above, the filter layer 16 may be configured either from 2 layers or from 3 or more layers of the superimposed melt blown nonwoven fabric layers 16A. In addition to the plural melt blown nonwoven fabric layers 16A, the insert layer 16B, configured from a nonwoven fabric that differs from the melt blown nonwoven fabric configuring the melt blown nonwoven fabric layers 16A in characteristics, material, or both, may also be provided. The insert layer 16B may be disposed between the melt blown nonwoven fabric layers 16A as illustrated in FIG. 4B, or may be disposed on the inner layer 15 side of the melt blown nonwoven fabric layers 16A as illustrated in FIG. 4C. Conversely, the insert layer 16B may also be disposed on the outer layer 17 side of the melt blown nonwoven fabric layers 16A.

Examples of melt blown nonwoven fabric that may be used for the melt blown nonwoven fabric layers 16A include those manufactured by hot melt extrusion of a thermoplastic resin such as a polyolefin resin, a polyester resin, or a thermoplastic polyamide resin from a fine nozzle under hot air. Specific examples thereof include: polyolefin resin melt blown nonwoven fabrics such as a polypropylene resin melt blown nonwoven fabric, a polyethylene resin melt blown nonwoven fabric, or an ethylene-propylene resin melt blown nonwoven fabric; polyester resin melt blown nonwoven fabrics such as a polyethylene terephthalate resin melt blown nonwoven fabric, a poly-trimethylene terephthalate resin melt blown nonwoven fabric, or a polybutylene terephthalate resin melt blown nonwoven fabric; and polyamide resin melt blown nonwoven fabrics such as a Nylon 6 (trade name) melt blown nonwoven fabric, a Nylon 66 melt blown nonwoven fabric, or a Nylon 612 melt blown nonwoven fabric.

Of these melt blown nonwoven fabrics, polyolefin resin melt blown nonwoven fabrics are preferable, and of these, a polypropylene resin melt blown nonwoven fabric and a polyethylene resin melt blown nonwoven fabric are particularly preferable.

From the perspective of balancing filtration efficiency against foreign objects such as bacteria, viruses, and pollen with achieving a low breathing resistance, the grammage of the melt blown nonwoven fabric is preferably in a range of between 5 to 20 $g/m^2$ and particularly preferably in a range of between 7 to 15 $g/m^2$.

The insert layer 16B may be configured by an antimicrobial nonwoven fabric layer, or may be configured by a blood fluid blocking layer.

Examples of antimicrobial nonwoven fabrics that may be used for an antimicrobial nonwoven fabric layer include various nonwoven fabrics such as melt blown nonwoven fabrics or spunbond nonwoven fabrics that are manufactured by mixing an antimicrobial agent such as silver into various resins such as a polypropylene resin, a polyethylene resin or a polyethylene terephthalate resin. Nonwoven fabrics such as melt blown nonwoven fabric or spunbond nonwoven fabrics treated with various antimicrobial agents may also be used as an antimicrobial nonwoven fabric. The grammage of such an antimicrobial nonwoven fabric is preferably in a range of between 10 to 30 g/m$^2$ and particularly preferably in a range of between 15 to 25 g/m$^2$.

Examples of materials employed for blood fluid blocking layers include spunbond nonwoven fabrics with grammage between 20 to 40 g/m$^2$, and preferably between 25 to 35 g/m$^2$, that are manufactured from a resin material selected from a group including polyolefin resins such as a polypropylene resin, a polyethylene resin, or an ethylene-propylene resin; and a polyester resin such as a poly-trimethylene terephthalate resin or a polybutylene terephthalate resin.

The inner layer 15 is positioned on the mouth side of the wearer when the mask 1 is being worn. The inner layer 15 is accordingly a portion that is in direct contact with the skin of the wearer, and thus, is designed so as not to damage the skin of the wearer through contact. Specific examples that may be used include thermal bonded nonwoven fabrics, mixed material papers made from a mixture of pulp and polyester fibers, and rayon papers.

The outer layer 17 is the outer-most layer of the mask main body 11, that is to say, the layer positioned furthest to the outside of the mask main body 11, and serves primarily to protect the filter layer 16. Materials that may be employed for the outer layer 17 include spunbond nonwoven fabrics or mixed material papers with a grammage in a similar range to, or a somewhat greater range than, the melt blown nonwoven fabric employed for the filter layer 16. Specifically, a spunbond nonwoven fabric or a mixed material paper of grammage in the region of 15 to 25 g/ms$^2$ may be employed.

Figure 5:
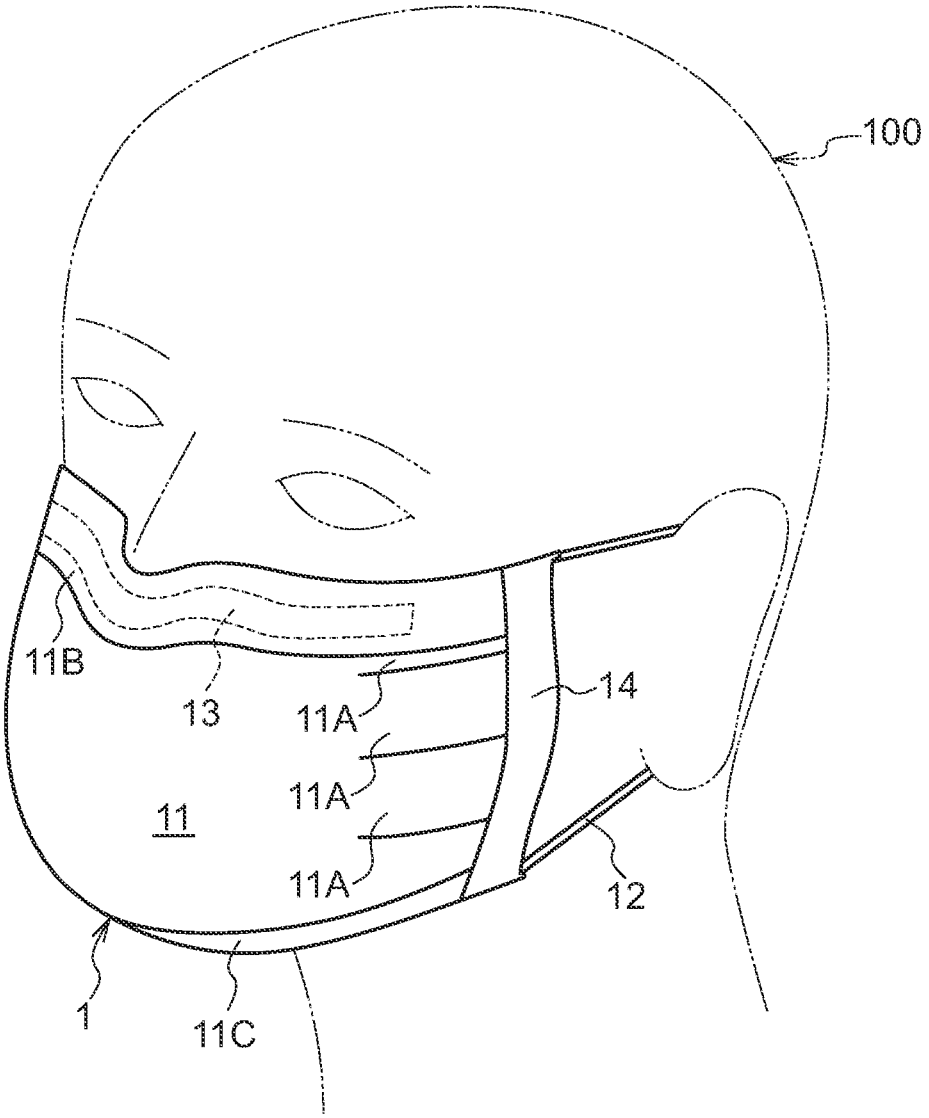
FIG. 5 is a schematic perspective view illustrating a mask of the first exemplary embodiment that is being worn.

When a wearer 100 wears the mask 1, the 2 elastic cords 12 of the mask 1 are respectively placed around the ears of the wearer as illustrated in FIG. 5, and the nose grip 13 is bent to span across and follow the shape of the bridge of the nose. The mask 1 is worn with the upper edge portion 11B of the mask main body 11 held close against the face. When the mask 1 is put on, the folded-over portion 11A of the mask main body 11 expands at the central portion thereof, thus covering the nose and mouth of the wearer 100.

Examples 1 to 6 and Comparative Examples 1 to 5

Table 1 below illustrates characteristics of configuration materials employed in the inner layer 15, filter layer 16, and outer layer 17 of Examples 1 to 6 and of Comparative Examples 1 to 5.

TABLE 1

| | | Material number | | | | | | | | |
|---|---|---|---|---|---|---|---|---|---|---|
| | | 1 | 2 | 3 | 4 | 5 | 6 | 7 | 8 | 9 |
| Material | | PP Thermal Bonded | PET/Pulp Mixed Paper | PP Melt Blown | PP Melt Blown | PP Melt Blown | PP Spunbond | PP Spunbond (Antimicrobial Treated) | PP Spunbond | PP Spunbond |
| Purpose | | Inner Material 1 | Inner Material 2 | Filter Material 1 | Filter Material 2 | Filter Material 3 | Outer Material 1 | Insert Material 1 | Insert Material 2 | Insert Material 3 |
| Grammage g/m$^2$ | Av | 20.2 | 17.8 | 10.10 | 20.2 | 25.4 | 17.5 | 20.4 | 30.4 | 24.8 |
| | Max | 21.5 | 18.3 | 10.32 | 20.7 | 26.4 | 18.3 | 21.1 | 32.1 | 26.2 |
| | Min | 19.1 | 17.5 | 9.80 | 19.7 | 24.8 | 17.2 | 19.2 | 26.8 | 23.0 |
| | $\sigma_n$ | 0.7 | 0.2 | 0.12 | 0.3 | 0.62 | 0.96 | 1.10 | 1.68 | 1.40 |
| TSI ΔP mmAq | Av | 1.37 | 1.68 | 5.60 | 13.4 | 8.3 | 1.02 | 1.14 | 1.95 | 1.67 |
| | Max | 1.48 | 1.78 | 5.72 | 14.2 | 8.8 | 1.13 | 1.23 | 2.11 | 1.98 |
| | Min | 1.22 | 1.60 | 5.41 | 13.0 | 7.9 | 0.95 | 1.08 | 1.78 | 1.36 |
| | $\sigma_n$ | 0.06 | 0.07 | 0.11 | 0.25 | 0.23 | 0.06 | 0.07 | 0.31 | 0.26 |
| TSI filtration Efficiency | Av | — | — | 47.0 | 75.0 | 63.3 | — | — | — | — |
| | Max | — | — | 48.3 | 77.3 | 64.6 | — | — | — | — |
| | Min | — | — | 44.6 | 73.1 | 62.1 | — | — | — | — |
| | $\sigma_n$ | — | — | 1.2 | 1.12 | 0.89 | — | — | — | — |

In table 1, differential pressure (ΔP) and particle filtration efficiency (PFE) are measured using a filtration tester manufactured by TSI Filtration Technologies, Inc. Note that in Table 1, "Inner Material 1" and "Inner Material 2" refer to materials employed for the inner layer 15, "filter material 1", "filter material 2" and "filter material 3" refer to materials employed for the melt blown nonwoven fabric layer 16A of the filter layer 16, and "outer material 1" refers to the material employed for the outer layer 17. "Insert material 1", "insert material 2" and "insert material 3" refer to the material employed for the insert layer 16B of the filter layer 16.

Example 1

The fabric 18 of a 4-layered superimposed configuration illustrated in FIG. 4A is manufactured employing the inner material 1 (polypropylene (PP) thermal bonded nonwoven fabric of grammage 20 g/m$^2$) for the inner layer 15, employing the outer material 1 (PP spunbond nonwoven fabric of grammage 18 g/m$^2$) for the outer layer 17, and employing 2 sheets of the filter material 1 (PP melt blown nonwoven fabric of grammage 10 g/m$^2$) for the filter layer 16.

Both edges of the whole cloth of the fabric 18 are welded to form the upper edge portion 11B and the lower edge portion 11C. The nose grip 13 is inserted into the upper edge portion 11B, and the base cloth is folded into a pleated shape using a folding board to form the folded-over portion 11A.

Next, the whole cloth is cut to the length (175 mm) of the mask main body 11, giving a cut product. The cut edges of the cut product are then enveloped in a polyester nonwoven fabric tape (width 25 mm) and are welded to form the reinforcement strips 14. After forming the reinforcement strips 14, one end and the other end of the respective elastic cords 12 are thermally welded to the upper ends and lower ends of the reinforcement strips 14, thereby manufacturing the mask of the configuration of the first exemplary embodiment.

Differential pressure (ΔP) and particle filtration efficiency (PFE) are then measured for the manufactured mask using a TSI filtration tester. Moreover, in order to verify the reliability of measurement, the manufactured mask is sent to NELSON Laboratories (United States of America), a public testing agency, and bacterial filtration efficiency (BFE) is measured according to the method set out in ASTM F2100. The results are illustrated in Table 2.

1 is employed as the filter layer 16. Performance thereof is evaluated as described in EXAMPLE 1. Results are shown in Table 2.

Comparative Example 2

A mask is manufactured following a similar process to the Example 1, except in that the filter layer 16 is configured by superimposing the filter material 2 (PP melt blown nonwoven fabric of grammage 20 g/m$^2$) and the insert material 1. Performance thereof is evaluated as described in EXAMPLE 1. Results are shown in Table 2.

TABLE 2

| | | | Example 1 | Example 2 | Example 3 | Comparative Example 1 | Comparative Example 2 | Comparative Example 3 |
|---|---|---|---|---|---|---|---|---|
| Filter Configuration | Inner layer 15 | | Inner Material 1 | Inner Material 1 | Inner Material 1 | Inner Material 1 | Inner Material 1 | Inner Material 2 |
| | Filter Layer 16 | | Filter Material 1/ Filter Material 1 | Filter Material 1/ Insert Material 1/ Filter Material 1 | Filter Material 1/ Filter Material 1 | Filter Material 1 | Filter Material 2/ Insert Material 1 | Filter Material 1 |
| | Outer layer 17 | | Outer Material 1 | Outer Material 1 | Outer Material 1 | Outer Material 1 | Outer Material 1 | Outer Material 1 |
| Mask Performance TSI Method | Differential pressure ΔP (mmAq) | Av | 13.6 | 14.4 | 14.6 | 9.4 | 17.3 | 17.2 |
| | | Max | 13.9 | 14.9 | 14.8 | 10.8 | 18.2 | 17.7 |
| | | Min | 13.3 | 14.0 | 14.4 | 8.1 | 14.5 | 16.8 |
| | | $\sigma_n$ | 0.2 | 0.3 | 0.2 | 0.6 | 0.7 | 0.4 |
| | Particle Filtration Efficiency (PFE (%)) | Av | 75.0 | 75.2 | 75.0 | 47.5 | 74.8 | 75.0 |
| | | Max | 76.1 | 76.1 | 76.5 | 48.5 | 77.5 | 77.6 |
| | | Min | 74.2 | 74.4 | 74.1 | 46.3 | 72.8 | 73.2 |
| | | $\sigma_n$ | 0.82 | 0.83 | 0.87 | 1.18 | 1.14 | 1.12 |
| NELSON LABORATORIES Bacterial Filtration Efficiency (BFE (%)) | | | 99≥ | 99≥ | 99≥ | 96.5 | 99≥ | 99≥ |

Example 2

A mask is manufactured following a similar process to the Example 1, except in that the insert material 1 (antimicrobial treated PP spunbond nonwoven fabric of grammage 20 g/m$^2$) is inserted between 2 sheets of the filter material 1 in the filter layer 16, giving the 5 layered superimposed configuration illustrated in FIG. 4B. Performance thereof is evaluated as described in EXAMPLE 1. The results are illustrated in Table 2.

Example 3

A mask is manufactured following a similar process to the Example 1, except in that the mask is configured as a medical mask wherein instead of enveloping the cut edges of the semi-product in nonwoven fabric tape (width 25 mm), the cut edges are enveloped in a PP nonwoven fabric tape of width 30 mm and the cut edges welded to form the reinforcement strips 14, and the PP nonwoven fabric tape is extended out both up and down from the mask main body 11 by 400 mm to form tie strings. The tie string portions are then tied together so as to fix the mask to the face of the wearer. Performance thereof is evaluated as described in EXAMPLE 1. Results are shown in Table 2.

Comparative Example 1

A mask is manufactured following a similar process to the Example 1, except in that only 1 layer of the filter material Comparative Example 3

A mask is manufactured following a similar process to the Example 1, except in that the inner layer 15 is configured from the inner material 2 (a mixed material paper of PET fibers and pulp), and the filter layer 16 is configured from 1 layer of the filter material 1. Performance thereof is evaluated as described in EXAMPLE 1. Results are shown in Table 2.

Comparison of Examples 1 to 3 with Comparative Examples 1 to 3

As can be seen from Table 2, the masks of Example 1 to Example 3 have a differential pressure ΔP measured by the TSI filtration tester of about 13 to 15 mmAq, and Particle Filtration Efficiency (PFE (%)) of about 74% to 77%. The Bacterial Filtration Efficiency (BFE (%)) measured at NELSON Laboratories is 99% or above.

By contrast, since the filter of the Comparative Example 1 only employs one layer of the filter material 1 as the filter layer 16, although the differential pressure ΔP measured by the TSI filtration tester is 9 to 10 mmAq and better than that of the masks of the Example 1 to Example 3, the Particle Filtration Efficiency (PFE (%)) is at about 46% to 49% and worse than that of the masks of the Example 1 to Example 3. Moreover, the Bacterial Filtration Efficiency (BFE (%)) measured at NELSON Laboratories is 96.5%.

In the mask of the Comparative Example 2, the filter layer 16 employs the filter material 2 that is of higher grammage than the filter material 1. In the mask of the Comparative Example 3, the inner layer 15 employs the mixed material paper of PET/paper pulp. The Particle Filtration Efficiency (PFE) and the Bacterial Filtration Efficiency (BFE) measured by the TSI filtration tester are accordingly similar to those of the masks of the Example 1 to Example 3, however the differential pressure ΔP measured by the TSI filtration tester for the masks of the Comparative Example 2 and the Comparative Example 3 is high, at about 14 to 18 mmAq, and moreover the standard deviation $\sigma_n$ is 0.4 to 0.7 mmAq, which is larger than the standard deviation $\sigma_n$ of 0.2 to 0.3 mmAq of the masks of the Example 1 to Example 3.

From these results, it can be seen that for the masks of Comparative Example 1 to Comparative Example 3, the Particle Filtration Efficiency (PFE) and the Bacterial Filtration Efficiency (BFE) deteriorate when attempting to reduce the differential pressure ΔP to the level of the masks of the Example 1 to Example 3, and that the differential pressure ΔP increases when attempting to improve the Particle Filtration Efficiency (PFE) and the Bacterial Filtration Efficiency (BFE) to the level of the masks of the Example 1 to Example 3.

Example 4

A medical mask is manufactured following a similar process to the Example 3, except in that the filter layer 16 is configured by a 3 layer configuration of the insert material 2 interposed between 2 layers of the filter material 1. Differential pressure ΔP and Particle Filtration Efficiency (PFE) are measured for the manufactured mask following similar procedures to those used for the Example 1 to Example 3. The mask is moreover sent to NELSON Laboratories (United States of America) and Bacterial Filtration Efficiency (BFE) and blood fluid impermeability (Fluid Resistance: FR) are measured according to the procedure set out in ASTM F2100. Results are illustrated in Table 3.

Example 5

A medical mask is manufactured following a similar process to the Example 4, except in that the insert material 3 is used in place of the insert material 2 for the insert layer 16B. Differential pressure ΔP and Particle Filtration Efficiency (PFE) are measured for the manufactured mask following similar procedures to those used for the Example 1 to Example 3. The mask is moreover sent to NELSON Laboratories (United States of America) and Bacterial Filtration Efficiency (BFE) and blood fluid impermeability (FR) are measured according to the procedure set out in ASTM F2100. Results are illustrated in Table 3.

Example 6

A medical mask is manufactured following a similar process to the Example 5, except in that the filter layer 16 is configured by 2 superimposed layers of the melt blown nonwoven fabric layers 16A, and the insert layer 16B is superimposed on the melt blown nonwoven fabric layers 16A on the mouth side of the melt blown nonwoven fabric layers 16A. Differential pressure ΔP and Particle Filtration Efficiency (PFE) are measured for the manufactured mask following similar procedures to those used for the Example 1 to Example 3. The mask is moreover sent to NELSON Laboratories (United States of America) and Bacterial Filtration Efficiency (BFE) and blood fluid impermeability (FR) are measured according to the procedure set out in ASTM F2100. Results are illustrated in Table 3.

Comparative Example 4

A medical mask is manufactured following a similar process to the Example 4, except in that the filter layer 16 is configured by superimposing each one of the filter material 2 and the insert material 2. Differential pressure ΔP and Particle Filtration Efficiency (PFE) are measured for the manufactured mask following similar procedures to those used for the Example 1 to the Example 3. The mask is moreover sent to NELSON Laboratories (United States of

TABLE 3

| | | | Example 4 | Example 5 | Example 6 | Comparative Example 4 | Comparative Example 5 |
|---|---|---|---|---|---|---|---|
| Filter Configuration | Inner layer 15 | | Inner Material 1 | Inner Material 1 | Inner Material 1 | Inner Material 1 | Inner Material 1 |
| | Filter Layer 16 | | Filter Material 1/ Insert Material 2/ Filter Material 1 | Filter Material 1/ Insert Material 3/ Filter Material 1 | Filter Material 1/ Filter Material 1/ Insert Material 3 | Filter Material 2/ Insert Material 2 | Filter Material 3/ Insert Material 2 |
| | Outer layer 17 | | Outer Material 1 | Outer Material 1 | Outer Material 1 | Outer Material 1 | Outer Material 1 |
| Mask Performance TSI Method | Differential Pressure ΔP (mmAq) | Av | 15.7 | 15.2 | 15.4 | 17.9 | 13.2 |
| | | Max | 16.0 | 15.5 | 15.7 | 18.3 | 13.5 |
| | | Min | 15.5 | 15.0 | 15.2 | 17.5 | 12.6 |
| | | $\sigma_n$ | 0.2 | 0.13 | 0.16 | 0.3 | 0.4 |
| | Particle Filtration Efficiency (PFE (%)) | Av | 75.2 | 75.1 | 75.1 | 75.0 | 63.5 |
| | | Max | 76.5 | 76.6 | 76.9 | 77.4 | 64.3 |
| | | Min | 74.1 | 74.1 | 73.6 | 73.2 | 62.0 |
| | | $\sigma_n$ | 0.95 | 0.96 | 0.99 | 1.18 | 0.90 |
| NELSON LABORATORIES | Bacterial Filtration Efficiency (BFE (%)) | | 99≥ | 99≥ | 99≥ | 99≥ | 99≥ |
| | Synthetic Blood Penetration Resistance (Fluid Resistance: FR) | Pass (No.) | 32 | 32 | 32 | 27 | 29 |
| | | Fail (No.) | 0 | 0 | 0 | 5 | 3 |
| | | Pass/Fail | Pass | Pass | Pass | Fail | Pass |

America) and Bacterial Filtration Efficiency (BFE) and blood fluid impermeability (FR) are measured according to the procedure set out in ASTM F2100. Results are illustrated in Table 3.

Comparative Example 5

A medical mask is manufactured following a similar process to the Example 4, except in that the filter layer 16 is configured employing the filter material 3 instead of the filter material 2, with each one of the filter material 3 and the insert material 2 superimposed on each other. Differential pressure ΔP and Particle Filtration Efficiency (PFE) are measured for the manufactured mask following similar procedures to those used for the Example 1 to Example 3. The mask is moreover sent to NELSON Laboratories (United States of America) and Bacterial Filtration Efficiency (BFE) and blood fluid impermeability (FR) are measured according to the procedure set out in ASTM F2100. Results are illustrated in Table 3.

Comparison of Examples 4 to 6 with Comparative Examples 4 and 5

As can be seen from Table 3, the masks of Example 4 to Example 6 have a differential pressure (ΔP) measured by the TSI filtration tester of 15 to 16 mmAq, with little variability shown by the standard deviations $\sigma_n$ of 0.16 to 0.2 mmAq. The Particle Filtration Efficiency (PFE (%)) is about 74% to 76%, with little variability shown by the standard deviations $\sigma_n$ of 0.95 to 0.99. The Bacterial Filtration Efficiency (BFE) is 99% or above. 32 masks of each of the Examples are measured for blood fluid impermeability (FR), with none of the masks showing leakage of synthetic blood at a pressure of 160 mmHg. Thus, as for the Examples 4 to 6, the results are "pass".

In contrast thereto, the mask of the Comparative Example 4 has a differential pressure ΔP measured by the TSI filtration tester of 17.5 to 18.9 mmAq, with the standard deviation $\sigma_n$ thereof of 0.3 mmAq, showing larger variability than in the Examples 4 to 6. The Particle Filtration Efficiency (PFE) is 73.2% to 77.4%, with a standard deviation $\sigma_n$ at 1.18 showing larger variability than the Examples 4 to 6. Although the Bacterial Filtration Efficiency (BFE) is 99% or above, 5 of the masks show leakage of synthetic blood at a pressure of 160 mmHg when 32 masks are measured for blood fluid impermeability (FR), thereby resulting in the "Failure".

The mask of the Comparative Example 5 has a differential pressure ΔP measured by the TSI filtration tester of 12.6 to 13.5 mmAq, lower than that of the Examples 4 to 6 and the Comparative Example 4. However, the standard deviation $\sigma_n$ at 0.4 mmAq shows a larger variability than the Examples 4 to 6. The Particle Filtration Efficiency (PFE) of 62.0% to 64.3% is lower than that of the Examples 4 to 6 and the Comparative Example 4. Moreover, although the Bacterial Filtration Efficiency (BFE) is 99% or above, 3 of the masks show leakage of synthetic blood at a pressure of 160 mmHg in 32 masks that are measured for blood fluid impermeability (FR), which although deemed to be the "Pass", is however inferior to the Examples 4 to 6 wherein leakage of synthetic blood was not shown at a pressure of 160 mmHg.

It might be considered that the variability in filtration performance is reduced during testing, the variability in filtration performance within the mask is reduced and that blood fluid impermeability (FR) is improved in the masks of each of the Examples 1 to 6 due to employing plural layers in the melt blown nonwoven fabric filter layer. In contrast thereto, it might be considered that the increased variability in filtration performance during testing with the masks of each of the Comparative Examples 1 to 5 arises due to not employing plural layers in the melt blown nonwoven fabric filter layer. It can moreover be seen from the Comparative Example 4 and the Comparative Example 5 that blood fluid impermeability (FR) falls when plural layers of melt blown nonwoven fabric are not employed.

The foregoing description of the exemplary embodiments of the present invention has been provided for the purpose of illustration and description. It is not intended to be exhaustive or to limit the invention to the precise forms disclosed. Obviously, many modification and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A mask comprising:

a mask main body including an inner layer that is adapted to be positioned over the mouth of a wearer when the mask is being worn, an outer layer that is on the outside of the mask when the mask is being worn, and a filter layer that is positioned between the inner layer and the outer layer and consists of two melt blown nonwoven fabric layers and one insert layer that is a layer of a nonwoven fabric that differs from the two melt blown nonwoven fabric layer in characteristics; and a cord that is adapted to be placed over both ears or the head of the wearer to fix the mask main body at a specific position on the face of the wearer when the mask is being worn, wherein the two melt blown nonwoven fabric layers are formed of a polypropylene resin and have a weight per unit area of 7-15 g/m$^2$, and wherein the insert layer is a spun bond nonwoven fabric formed of a polypropylene resin and has a weight per unit area of 10-30 g/m$^2$.

2. The mask of claim 1 wherein the filter layer is formed by superimposing the two melt blown nonwoven fabric layers on each other.

3. The mask of claim 1, wherein the insert layer is inserted between the two melt blown nonwoven fabric layers.

4. The mask of claim 1 wherein the insert layer is an antimicrobial nonwoven fabric layer configured from an antimicrobial treated nonwoven fabric.

5. The mask of claim 1 wherein the insert layer is a blood fluid blocking layer that suppresses the permeation of blood.

6. The mask of claim 1, wherein the insert layer is inserted between the two melt blown nonwoven fabric layers.

7. The mask of claim 1, wherein the insert layer is inserted between one of the two melt blown nonwoven fabric layers and the inner layer.

8. The mask of claim 1, wherein the insert layer is inserted between one of the two melt blown nonwoven fabric layers and the outer layer.

9. The mask of claim 1, wherein the insert layer is inserted between the two melt blown nonwoven fabric layers and the inner layer.

10. The mask of claim 1, wherein the inner layer is formed of polypropylene thermal bond nonwoven fabric or cellulose-containing nonwoven fabric.

11. The mask of claim 1, wherein the insert layer is inserted between the two melt blown nonwoven fabric layers and the outer layer.

* * * * *